US009864319B2

(12) United States Patent
Imaizumi

(10) Patent No.: US 9,864,319 B2
(45) Date of Patent: Jan. 9, 2018

(54) IMAGE FORMING APPARATUS

(71) Applicant: CANON KABUSHIKI KAISHA, Tokyo (JP)

(72) Inventor: Toru Imaizumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/405,116

(22) Filed: Jan. 12, 2017

(65) Prior Publication Data

US 2017/0205755 A1 Jul. 20, 2017

(30) Foreign Application Priority Data

Jan. 18, 2016 (JP) ..... 2016-007466

(51) Int. Cl.
*G03G 15/00* (2006.01)

(52) U.S. Cl.
CPC ..... *G03G 15/80* (2013.01)

(58) Field of Classification Search
CPC ..... G03G 15/1605; G03G 15/161; G03G 15/1615; G03G 15/0129
See application file for complete search history.

(56) References Cited

U.S. PATENT DOCUMENTS

2009/0129831 A1* 5/2009 Sakashita ..... G03G 15/1675 399/309
2009/0257764 A1* 10/2009 Okamoto ..... G03G 15/5029 399/66
2012/0002996 A1* 1/2012 Izumi ..... G03G 15/161 399/88
2013/0287420 A1* 10/2013 Taoka ..... G03G 15/16 399/66

FOREIGN PATENT DOCUMENTS

| | | | |
|---|---|---|---|
| JP | 6-124004 | A | 5/1994 |
| JP | 6-194972 | A | 7/1994 |
| JP | 10-279124 | A | 10/1998 |
| JP | 2001-139185 | A | 5/2001 |

* cited by examiner

*Primary Examiner* — Walter L Lindsay, Jr.
*Assistant Examiner* — Jessica L Eley
(74) *Attorney, Agent, or Firm* — Canon USA, Inc. I.P. Division

(57) ABSTRACT

The image forming apparatus includes a slide member configured to slide with a transfer material in a case that the transfer material is brought into contact with a transfer member, a grounding member configured to be electrically connected to the earth, and a connection member having conductivity and configured to be electrically connected to the slide member. The connection member includes a deforming portion deformed by an electrostatic force acting between the grounding member and the connection member, the slide member is conducted to the grounding member via the connection member in a case that the deforming portion is deformed and abuts on the grounding member, and the slide member is electrically insulated from the grounding member in a case that the deforming portion is separated from the grounding member.

20 Claims, 12 Drawing Sheets

IMAGE FORMING APPARATUS

BACKGROUND OF THE INVENTION

Field of the Invention

The present disclosure generally relates to an electrophotographic type image forming apparatus such as a copy machine and a printer.

Description of the Related Art

Electrophotographic type image forming apparatuses generally adopt methods in which voltage having opposite polarity to toners is applied to transfer members arranged to face image bearing members, thus toner images borne on the image bearing members are electrostatically transferred onto transfer materials such as sheets and overhead projector (OHP) sheets, and subsequently, fixing units fix the toner images to the transfer materials by heat and pressure.

The transfer material is sequentially conveyed from a sheet feeding cassette, a transfer unit, and the fixing unit by a conveyance roller and a conveyance belt and maintained in an appropriate conveyance orientation by a conveyance guide and a skew correction member arranged on a conveyance path. Members such as the conveyance roller, the conveyance belt, the conveyance guide, and the skew correction member are slide members slid with the transfer material when the transfer material is conveyed. When the slide members are arranged without grounding, there is a risk that the slide members are excessively charged by being slid with the transfer material and cause discharging. On the other hand, when the slide members are grounded, there is a risk that when resistance of the transfer material is lowered by moisture absorption in a high-humidity environment and the like, a transfer current is leaked from the transfer unit to the slide member via the transfer material and transfer defect may occur.

Japanese Patent Application Laid-Open No. 6-194972 describes a configuration which includes a switch circuit for switching grounding and non-grounding of a slide member slid with a transfer material and switches grounding and non-grounding of the slide member by switching ON/OFF of the switch based on an instruction from a control unit, such as a central processing unit (CPU).

However, the configuration described in Japanese Patent Application Laid-Open No. 6-194972 performs control to switch ON/OFF of the switch by providing the switch circuit, so that there is a risk of complicating the configuration of the image forming apparatus.

SUMMARY OF THE INVENTION

The present disclosure is directed to the provision of an image forming apparatus capable of switching grounding and non-grounding of a slide member with a simple configuration.

According to an aspect of the present disclosure, an image forming apparatus includes an image bearing member configured to bear a toner image, a transfer member configured to form a transfer area with the image bearing member and transfer the toner image from the image bearing member to a transfer material at the transfer area, a slide member configured to slide with the transfer material in a case that the transfer material is brought into contact with the transfer member, a grounding member configured to be electrically connected to the earth, and a connection member having conductivity and configured to be electrically connected to the slide member, wherein the connection member comprises a deforming portion deformed by an electrostatic force acting between the grounding member and the connection member, the slide member is conducted to the grounding member via the connection member in a case that the deforming portion is deformed and abuts on the grounding member, and the slide member is electrically insulated from the grounding member in a case that the deforming portion is separated from the grounding member.

Further features of the present disclosure will become apparent from the following description of exemplary embodiments with reference to the attached drawings.

DESCRIPTION OF THE EMBODIMENTS

Various exemplary embodiments of the present disclosure will be described in detail below with reference to the attached drawings. It is to be noted that components described in the exemplary embodiments are merely examples and not intended to limit the scope of the present disclosure.

Figure 1:
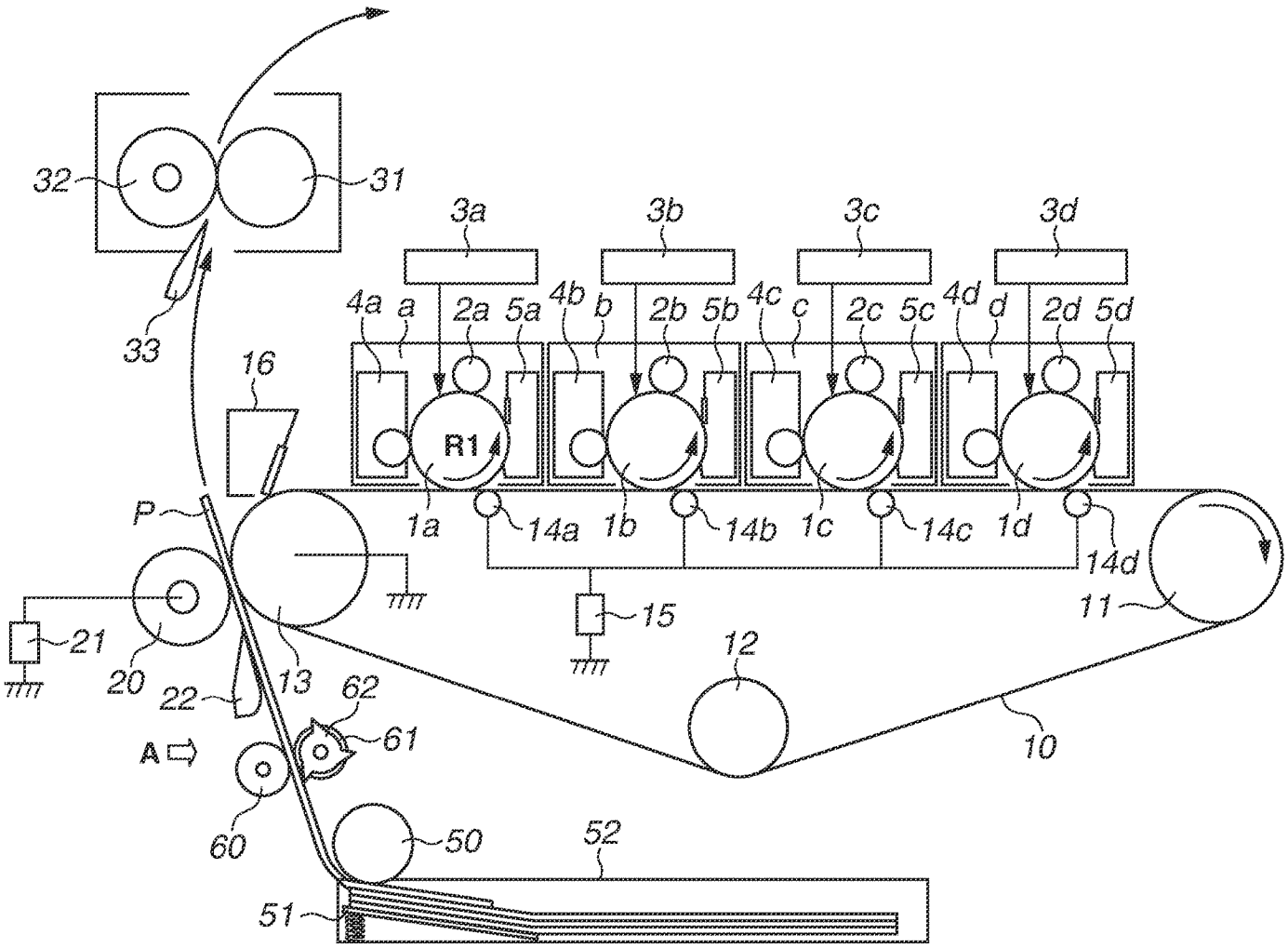
FIG. 1 is a schematic cross sectional view illustrating an image forming apparatus according to an exemplary embodiment.

FIG. 1 illustrates a configuration of a tandem type image forming apparatus including a plurality of image forming units a to d. A first image forming unit a, a second image forming unit b, a third image forming unit c, and a fourth image forming unit d form images of respective color toners of yellow (Y), magenta (M), cyan (C), and black (Bk). These four image forming units are arranged in a row at regular intervals, and configurations of the respective image forming units include many parts in substantially common with each other excepting the color of the toner. Therefore, the image forming apparatus according to a first exemplary embodiment is described below with reference to the first image forming unit a.

The first image forming unit a includes a photosensitive drum 1*a* as a photosensitive member, a charging roller 2*a* as a charging member, a development unit 4*a*, and a drum cleaning device 5*a*.

The photosensitive drum 1*a* is rotated and driven by a driving unit (not illustrated) to an illustrated arrow R1 direction (a counterclockwise direction) at a predetermined process speed. The development unit 4*a* is a development device which stores a yellow toner and develops a yellow toner image on the photosensitive drum 1*a*. The drum cleaning device 5*a* is a member for collecting a toner adhering to the photosensitive drum 1*a*. According to the present exemplary embodiment, the drum cleaning device 5*a* includes a cleaning blade (a cleaning member) abutting on the photosensitive drum 1*a* and a collected toner container for collecting the toner and the like removed from the photosensitive drum 1*a* by the cleaning blade.

When a control unit (not illustrated) such as a controller receives an image signal, an image forming operation is started, and the photosensitive drum 1*a* is rotated and driven. The photosensitive drum 1*a* is uniformly charged to a predetermined potential in a predetermined polarity (a negative polarity according to the present exemplary embodiment) by the charging roller 2*a* and exposed with light corresponding to the image signal by an exposure unit 3*a* in a rotation process. Accordingly, an electrostatic latent image corresponding to a yellow color component image of a target color image is formed. Next, the electrostatic latent image is developed by the development unit 4*a* at a development position and visualized as a yellow toner image. In this regard, a regular charging polarity of the toner stored in the development unit 4*a* is the negative polarity.

The image forming apparatus according to the present exemplary embodiment includes a rotatable endless intermediate transfer belt 10 as an image bearing member. The intermediate transfer belt 10 is formed from polyimide to which a conductive agent is added and has a perimeter of 700 mm, an axial direction length 240 mm, a thickness of 0.1 mm, and volume resistivity of $1*10^6$ Ω·m. The volume resistivity was measured by Hiresta-UP (MCP-HT450) manufactured by Mitsubishi Chemical using a UR Type ring probe (type MCP-HTP12) under conditions of a room temperature 23° C., a room humidity 50%, an applied voltage 100 V, and a measurement time 10 seconds.

The intermediate transfer belt 10 is stretched by a plurality of stretching rollers 11, 12, and 13, forms a primary transfer portion by abutting on the photosensitive drum 1*a*, and is rotated and driven at a process speed approximately same as that of the photosensitive drum 1*a*. The yellow toner image formed on the photosensitive drum 1*a* is primary transferred onto the intermediate transfer belt 10 by a primary transfer roller 14*a* to which voltage is applied from a primary transfer power source 15 at the primary transfer portion in which the photosensitive drum 1*a* abuts on the intermediate transfer belt 10. A primary-transfer remaining toner remaining on a surface of the photosensitive drum 1*a* is cleaned and removed by the drum cleaning device 5*a* and then used in an image forming process subsequent to the charging.

Subsequently, a magenta toner image of the second color, a cyan toner image of the third color, and a black toner image of the fourth color are respectively formed by the second, third, and fourth image forming units b, c, and d in the similar manner and successively transferred to the intermediate transfer belt 10 by overlapping with one another, and thus a four color toner image is obtained.

A secondary transfer roller 20 as a transfer member is pressed to an outer circumferential surface of the intermediate transfer belt 10 at a pressure of 50 N to form a secondary transfer nip portion as a transfer area. The stretching roller 13 is a conductive transfer counter member which faces the secondary transfer roller 20 via the intermediate transfer belt 10 at the secondary transfer nip portion.

A secondary transfer power source 21 as a voltage application unit is connected to the secondary transfer roller 20 and applies a voltage to the secondary transfer roller 20. The voltage is applied from the secondary transfer power source 21 to the secondary transfer roller 20, and thus an electric current is supplied from the secondary transfer roller 20 to the stretching roller 13. The voltage (secondary transfer voltage) applied to the secondary transfer roller 20 is controlled at approximately constant by feeding back, to the secondary transfer power source 21, a difference between a target voltage set in advance by the control unit (not illustrated) of the image forming apparatus and a detected voltage which is an actual output value. The secondary transfer power source 21 can output voltages in a rage from 100 [V] to 4000 [V].

The four color toner images transferred on the intermediate transfer belt 10 by the primary transfer are secondary transferred all together at the secondary transfer nip portion to a transfer material P as a transfer material conveyed by a pickup roller 50 as a sheet feeding member and a conveyance roller 60 as a conveyance member. The secondary transfer roller 20 is rotated following the intermediate transfer belt 10, and the transfer material P is sandwiched and conveyed by the secondary transfer nip portion.

Before image forming, the transfer material P is stored in a sheet feeding cassette 52, and when the image forming operation is started, a sheet feeding plate 51 presses the transfer material P in the sheet feeding cassette 52 to the pickup roller 50. In this state, the transfer material P is picked up one by one by the rotation of the pickup roller 50, fed to a conveyance nip portion formed by the conveyance roller 60 and a conveyance idler roller 61, and then conveyed to the secondary transfer nip portion.

A conveyance path in which the transfer material P is conveyed from the sheet feeding cassette 52 to the secondary transfer nip portion includes slide members slid with the transfer material P, such as a member for correcting skew of the transfer material P and a conveyance guide. According to the present exemplary embodiment, a shutter member 62 is provided as a slide member which abuts on the transfer material P to correct the skew and is slid with the transfer material P on an upstream side of the secondary transfer nip portion in a conveyance direction of the transfer material P. The shutter member 62 is disposed on a same axis line as the conveyance idler roller 61 being in contact with the transfer material P. The shutter member 62 is described in detail below.

A conveyance guide 22 which is disposed on the upstream side of the secondary transfer nip portion in the conveyance direction of the transfer material P is in contact with the transfer material P conveyed by the conveyance roller 60 to the secondary transfer nip portion and stably introduces the transfer material P to the secondary transfer nip portion by regulating the conveyance path of the transfer material P. The conveyance guide 22 is formed by a conductive resin and grounded via a path not illustrated.

After completion of the secondary transfer, the transfer material P bearing the four color toner images is conveyed to a fixing nip portion formed by a fixing roller 31 and a pressure roller 32, and the four color toners are melted and mixed by being heated and pressurized in the fixing nip portion and fixed to the transfer material P.

The fixing roller 31 is a roller with an outer diameter of 18 mm which is formed by providing an elastic layer of an insulating silicone rubber on an outer circumferential surface of a metal element tube and further coating an outer circumferential surface of the elastic layer with an insulating fluororesin (perfluoro alkoxyl alkane (PFA) tube) and includes a halogen heater (not illustrated) as a heating member therein. The halogen heater generates heat by being applied a voltage from a power source (not illustrated) not having contact with the fixing roller 31.

The pressure roller 32 is a roller with an outer diameter of 18 mm which is formed by providing an elastic layer of a conductive silicone rubber on an outer circumferential surface of a metal core and further coating an outer circumferential surface of the elastic layer with a conductive fluororesin (PFA tube) and is grounded from the metal core via a path not illustrated.

The fixing roller 31 forms the fixing nip portion by being pressed against the pressure roller 32 at a pressure of 147 N. The pressure roller 32 is rotated and driven by a driving unit (not illustrated), and the fixing roller 31 is rotated following the rotation and driving of the pressure roller 32. Accordingly, the transfer material P is conveyed in a state of being sandwiched by the fixing nip portion.

A conveyance guide 33 which is disposed on an upstream side of the fixing nip portion in the conveyance direction of the transfer material P regulates the conveyance path of the transfer material P by being brought into contact with the transfer material P conveyed to the fixing nip portion and stably introduces the transfer material P into the fixing nip portion. The conveyance guide 33 is formed by a conductive resin and grounded via a path not illustrated.

A toner remaining on the intermediate transfer belt 10 after the secondary transfer is cleaned and removed by a belt cleaning unit 16. The belt cleaning unit 16 includes a cleaning blade (a cleaning member) abutting on the intermediate transfer belt 10 and a collected toner container for collecting the toner removed by the cleaning blade from the intermediate transfer belt 10.

A full color print image is formed by the above-described operations.

Figure 2:
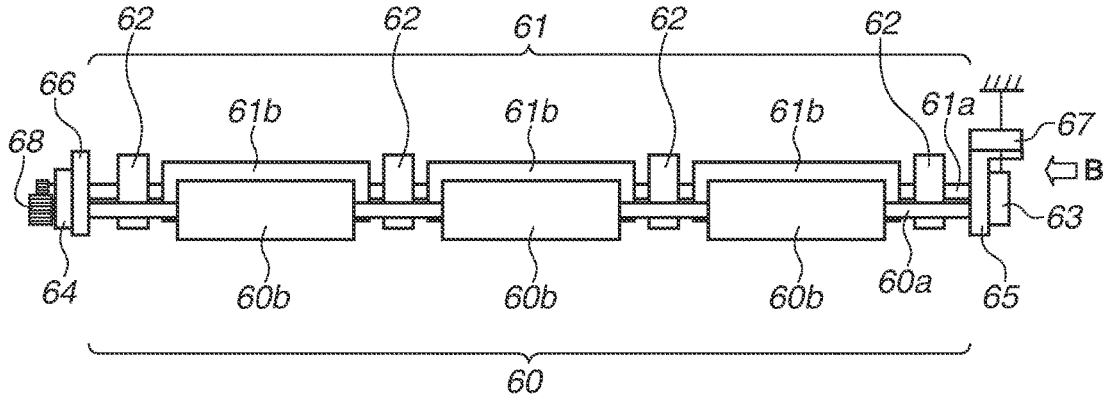
FIG. 2 is a schematic diagram illustrating a conveyance nip portion according to an exemplary embodiment.

Next, the conveyance nip portion according to the present exemplary embodiment is described in detail below. FIG. 2 is a schematic drawing illustrating a relationship of the conveyance roller 60, the conveyance idler roller 61, and the shutter member 62 viewed from an illustrated arrow A direction in FIG. 1. As illustrated in FIG. 2, the conveyance roller 60 includes a core metal 60*a* provided with conductive rubber rollers 60*b*, and three conductive rubber rollers 60*b* are arranged at regular intervals in an axial direction of the core metal 60*a*. Conductive idler rollers 61*b* formed by a conductive resin are provided on positions facing the respective conductive rubber rollers 60*b*, and the conductive idler rollers 61*b* form the conveyance idler roller 61 in a state rotatably held by a core metal 61*a*. The conveyance roller 60 is rotated and driven by a driving unit (not illustrated) via a gear unit 68, and the conductive idler rollers 61*b* are rotated following the rotation of the conveyance roller 60.

The shutter members 62 formed by a conductive resin are disposed on both sides of the conductive idler rollers 61*b* in an axial direction of the conveyance idler roller 61. A plurality of the shutter members 62 are disposed on a direction intersecting the conveyance direction of the transfer material P (hereinbelow, referred to as an orthogonal direction in the present specification) and rotatably held by the core metal 61*a*.

The core metal 60*a* and the core metal 61*a* are respectively held on the both ends by a conductive bearing 63 and an insulating bearing 64, and the conductive bearing and the insulating bearing 64 are each held by an insulating frame 65 and an insulating frame 66. Further, the insulating frame 65 and the insulating frame 66 are fixed to a main body frame of the image forming apparatus, and the conductive bearing 63 is electrically connected to a switch unit 67. The conductive bearing 63 is formed by a conductive resin, and the insulating bearing 64, the insulating frame 65, and the insulating frame 66 are formed by insulating resins.

Next, the shutter member 62 used in the present exemplary embodiment is described in detail. As illustrated in FIG. 2, a plurality of the shutter members 62 is disposed on a position apart from each other in a width direction intersecting the conveyance direction of the transfer material P. Accordingly, when a leading edge of the transfer material P abuts on the plurality of the shutter members 62, a position of the leading edge of the transfer material P is aligned, and skew of the transfer material P can be corrected.

FIGS. 3A to 3F are schematic cross sectional views of the conveyance nip portion viewed from the axial direction of the conveyance roller 60 and the conveyance idler roller 61 (an illustrated arrow B direction in FIG. 2). As illustrated in FIGS. 3A to 3F, the shutter member includes projecting portions 62*a*, 62*b*, and 62*c* protruding to be in contact with the transfer material P to be conveyed. Further, FIGS. 3A to 3F illustrate operations of the shutter member 62 from immediately before an identical transfer material P is fed to the conveyance nip portion to when the transfer material P is discharged, and straight arrows and curved arrows in the drawings respectively indicate the conveyance direction of the transfer material P and a rotation direction of the shutter member 62. The operations of the shutter member 62 are described below with reference to FIGS. 3A to 3F.

Figure 3A:
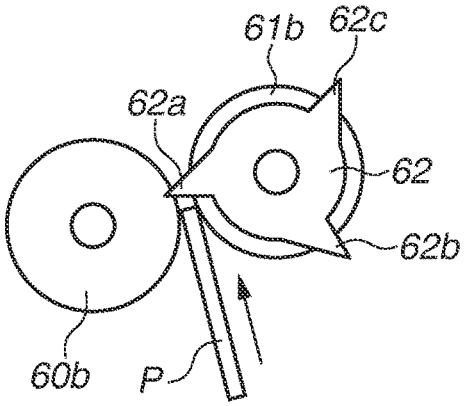
FIGS. 3A to 3F are schematic cross sectional views illustrating the conveyance nip portion according to an exemplary embodiment.

As illustrated in FIG. 3A, before the transfer material P is fed to the conveyance nip portion, the projecting portion 62*a* of the shutter member 62 remains still at the conveyance nip portion. As illustrated in FIG. 2, the plurality of the shutter members 62 is disposed on the position apart from each other in the width direction intersecting the conveyance direction of the transfer material P. In other words, the shutter members 62 includes a plurality of the projecting portions 62*a* which is disposed on the position apart from each other in the width direction intersecting the conveyance direction of the transfer material P and protrude to be in contact with the transfer material P.

Figure 3B:
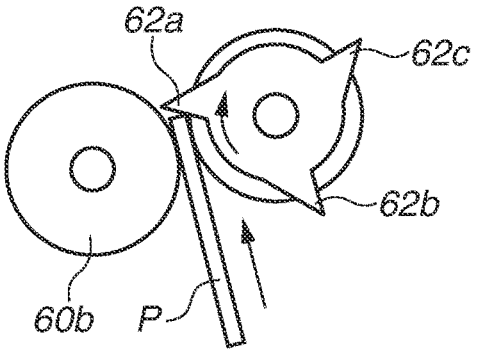

As illustrated in FIG. 3B, when feeding of the transfer material P is started toward the conveyance nip portion, the leading edge of the transfer material P abuts on the projecting portion 62*a*, and skew of the transfer material P is corrected. Subsequently, the transfer material P presses the projecting portion 62*a* toward the conveyance direction of the transfer material P by the conveyance of the transfer material P, and the shutter member 62 is rotated to a direction of the curved arrow. Accordingly, the projecting portion 62*a* is moved to separate from the conveyance nip portion.

Figure 3C:
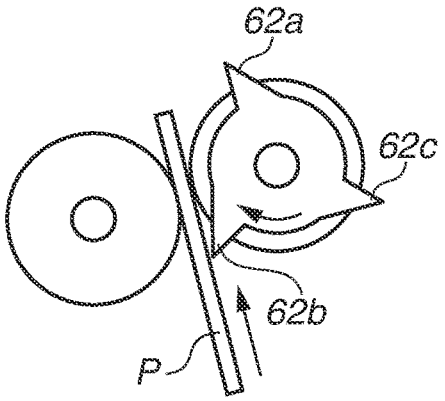

Further, when the projecting portion 62*a* is rotated and moved from the conveyance nip portion, a rotation unit (not illustrated) rotates the shutter member 62 in the direction of the curved arrow. Accordingly, as illustrated in FIG. 3C, the projecting portion 62*b* abuts on the conveyed transfer material P, and the transfer material P is slid with the projecting portion 62*b* of the shutter member 62.

Figure 3D:
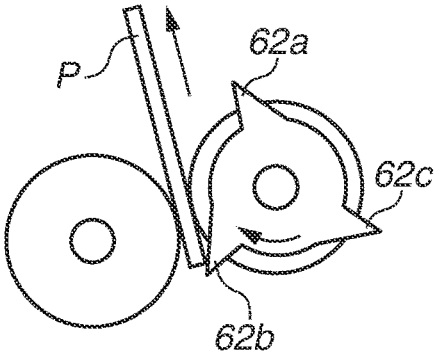
Figure 3E:
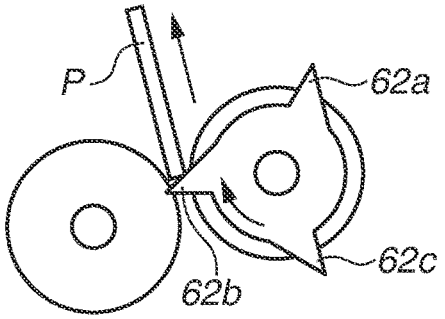

Further, as illustrated in FIG. 3D, immediately before a trailing edge of the transfer material P exits from the conveyance nip portion, the projecting portion 62*b* of the shutter member 62 is rotated and moved to the conveyance nip portion in such a way as to follow the trailing edge of the transfer material P. Subsequently, as illustrated in FIG. 3E, almost at the same time when the trailing edge of the transfer material P exits from the conveyance nip portion, the projecting portion 62*b* reaches the conveyance nip portion.

Figure 3F:
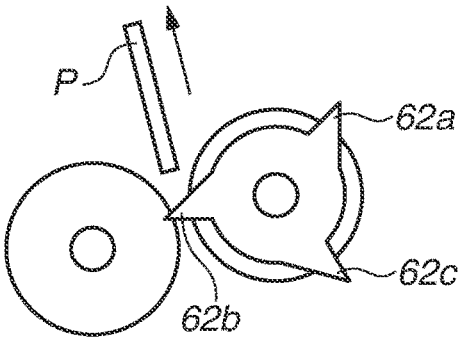

As illustrated in FIG. 3F, after the transfer material P is discharged from the conveyance nip portion, the projecting portion 62*b* of the shutter member 62 remains still in a state located at the conveyance nip portion. When a next transfer material P (a second the transfer material P) is fed to the conveyance nip portion in this state, operations similar to the above-described series of operations from FIGS. 3A to 3F are performed with respect to the projecting portion 62*b*, the transfer material P, and the projecting portion 62*c*. Accordingly, when the second transfer material P is discharged from the conveyance nip portion, the projecting portion 62*c* remains still in a state located at the conveyance nip portion, so that when the shutter member 62 repeats these rotation operations, the transfer material P is corrected the skew thereof and then conveyed to the transfer nip portion.

The switch unit 67 which is a characteristic feature of the present exemplary embodiment is described below with reference to FIG. 2, FIGS. 4A to 4C, and FIGS. 5A and 5B.

As illustrated in FIG. 2, the switch unit 67 is electrically connected to the conductive bearing 63 which holds one end side of the core metal 60*a* of the conveyance roller 60 and the core metal 61*a* of the conveyance idler roller 61 and disposed on the insulating frame 65.

Figure 4A:
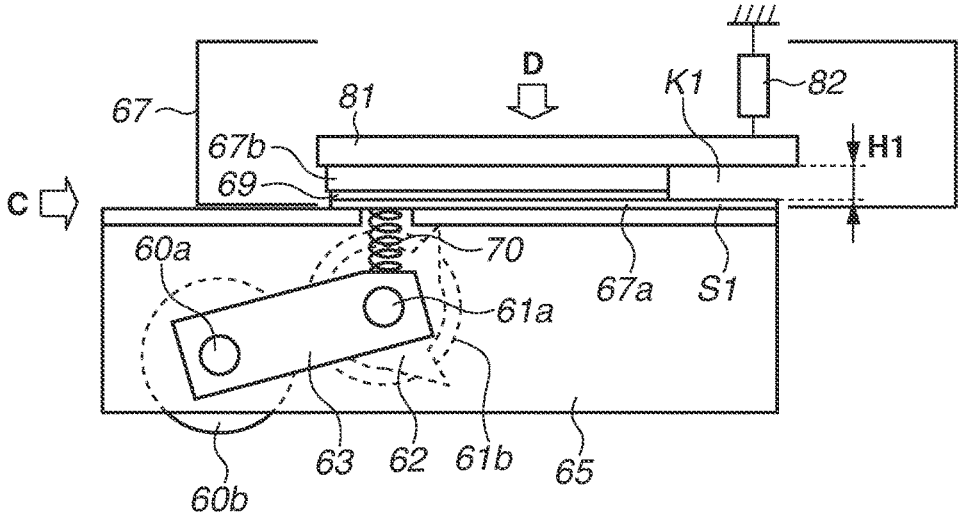
FIGS. 4A to 4C are schematic diagrams illustrating a grounding configuration of a slide member according to a first exemplary embodiment.
Figure 4B:
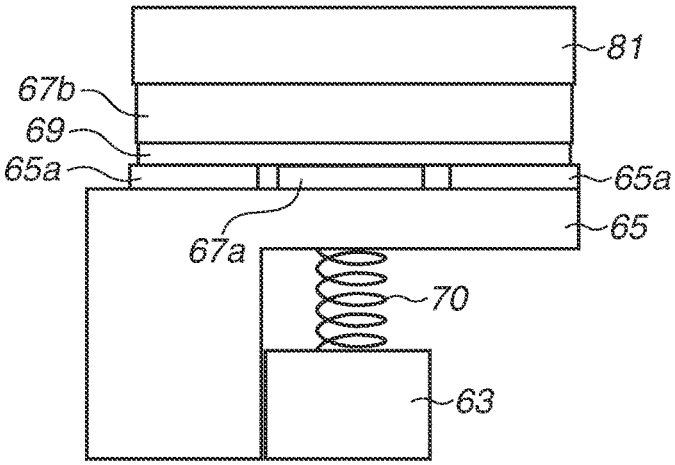

FIG. 4A illustrates the switch unit 67 viewed from an axial direction of the conveyance roller 60 (the illustrated arrow B direction in FIG. 2), and FIG. 4B is an enlarged cross-sectional view of the switch unit 67 viewed from the orthogonal direction (an illustrated arrow C direction in FIG. 4A) to the conveyance direction of the transfer material P.

As illustrated in FIG. 4A, the switch unit 67 according to the present exemplary embodiment includes a sheet member 67*a* (a connection member), a spacer member 67*b*, a conductive double-sided adhesive tape 69, a grounding member 81, and a resistor 82. The sheet member 67*a* of the switch unit 67 is electrically connected to the conductive bearing 63 via a metal spring 70 and thus also electrically connected to a member which is conducted to the conductive bearing 63. The conductive bearing 63 holds the one end side of the core metal 60*a* of the conveyance roller 60 and the core metal 61*a* of the conveyance idler roller 61, so that the conductive bearing 63 is conducted to the conductive rubber roller 60*b* held by the core metal 60*a* and the conductive idler roller 61*b* and the shutter member 62 held by the core metal 61*a*. Therefore, according to the present exemplary embodiment, the shutter member 62 as the slide member slid with the transfer material P is electrically connected to the sheet member 67*a* as the connection member.

Figure 5A:
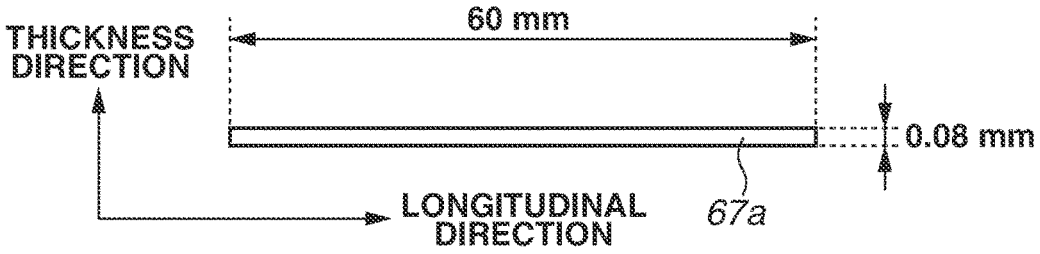
FIGS. 5A and 5B are schematic diagrams illustrating a connection member according to an exemplary embodiment.
Figure 5B:
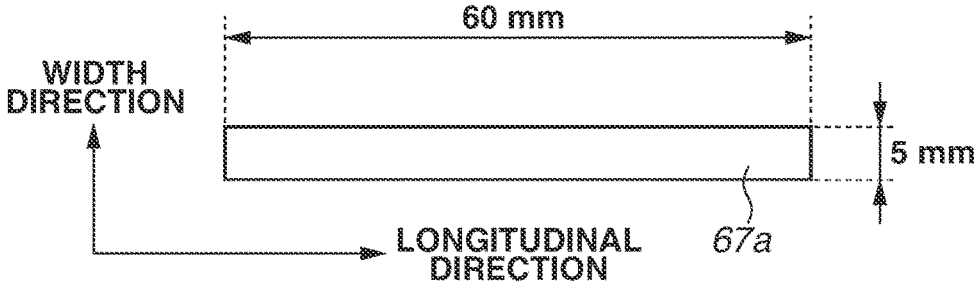

FIGS. 5A and 5B illustrate shapes of the sheet member 67*a*. The sheet member 67*a* according to the present exemplary embodiment is a thin plate-shaped conductor and has a longitudinal direction length of 60 mm, a width direction length of 5 mm, and a thickness of 0.08 mm. The sheet member 67*a* is a conductive resin sheet formed from polyimide to which a conductive agent is added and has a volume resistivity of $3.0*10^{-2}$ Ω·m and a tensile modulus of $3.0*10^{9}$ Pa. The tensile modulus was measured using a Precision Universal Tester, Autograph AGS-X (manufactured by Shimadzu Corporation) and a measurement method in compliance with a tensile modulus measurement method of JIS K 7127 at a test speed of 10 mm/min and a distance between chucks of 20 mm.

The spacer member 67*b* is an insulating polycarbonate sheet and has a width direction length of 15 mm and a thickness of 0.6 mm. The spacer member 67*b* is disposed by being sandwiched between the sheet member 67*a* and the grounding member 81 so as to keep a distance between the sheet member 67*a* and the grounding member 81 constant.

The grounding member 81 is a metal plate and electrically connected to the earth via the resistor 82. It is desirable that the resistor 82 has a resistance value of 100 MΩ or higher so as to suppress a transfer current from leaking from the secondary transfer roller 20 to the grounding member 81 via the transfer material P, and, according to the present exemplary embodiment, a resistor having a resistance value of 5 GΩ is used as the resistor 82.

Figure 4C:
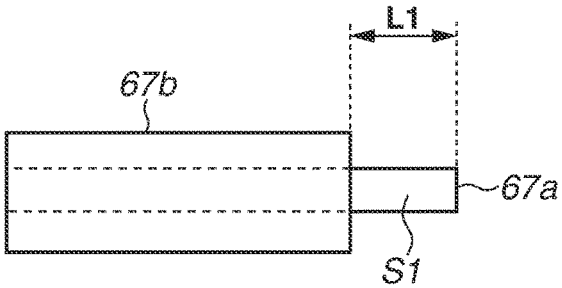

FIG. 4C is a schematic diagram of the spacer member 67*b* and the sheet member 67*a* viewed from an illustrated arrow D direction in FIG. 4A. The sheet member 67*a* and the spacer member 67*b* are sandwiched between the insulating frame 65 and the grounding member 81, and as illustrated in FIG. 4C, the sheet member 67*a* is held in a state in which a leading edge thereof is protruded from the spacer member 67*b* by a length L1, i.e., 8 mm in the longitudinal direction. A portion of the length L1 protruded from the spacer member 67*b* is a deforming portion S1 of the sheet member 67*a*, and the spacer member 67*b* is longer than the sheet member 67*a* by the length L1. Therefore, as illustrated in FIG. 4A, the spacer member 67*b* forms a void K1 between the grounding member 81 and the deforming portion S1 of the sheet member 67*a*.

According to the present exemplary embodiment, as illustrated in FIG. 4B, one end side of the sheet member 67*a* is fixed to a projection 65*a* of the insulating frame 65 by the spacer member 67*b* with the double-sided adhesive tape 69 having a thickness of 0.1 mm in the longitudinal direction of the sheet member 67*a*. A height of the projection 65*a* is 0.08 mm which is the same as the thickness of the sheet member 67*a*. The double-sided adhesive tape 69 is not stuck on a portion 8 mm from the leading edge of the sheet member 67*a* so as not to interfere the operation of the sheet member 67*a*. In other words, the sheet member 67*a* is regulated by the spacer member 67*b* on the one end side and includes the deforming portion S1 on the other end side in the longitudinal direction of the sheet member 67*a*. The spacer member 67*b* has a thickness of 0.6 mm, and the double-sided adhesive tape 69 has a thickness of 0.1 mm, so that a distance H1 (see FIG. 5A) between the grounding member 81 and the deforming portion S1 of the sheet member 67*a* is 0.7 mm.

Next, an action according to the present exemplary embodiment is described with reference to comparative examples.

Figure 6A:
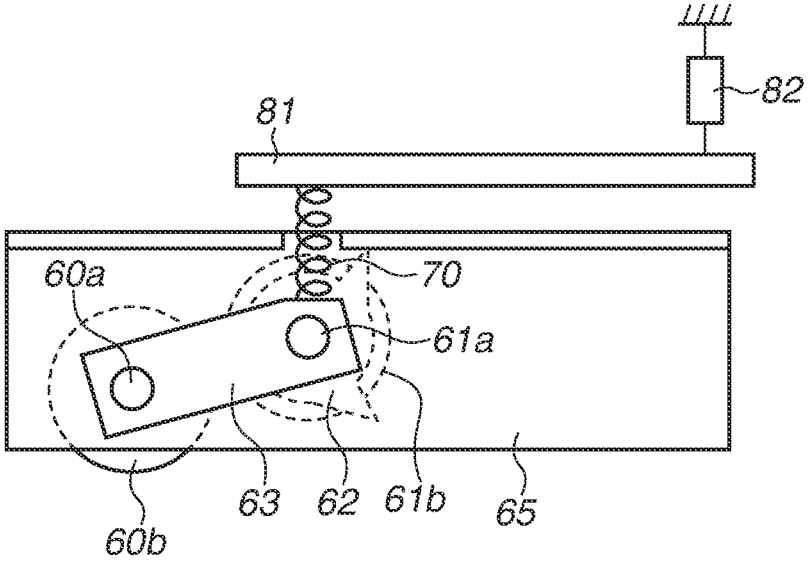
FIGS. 6A and 6B are schematic diagrams illustrating a grounding configuration according to comparative examples.
Figure 6B:
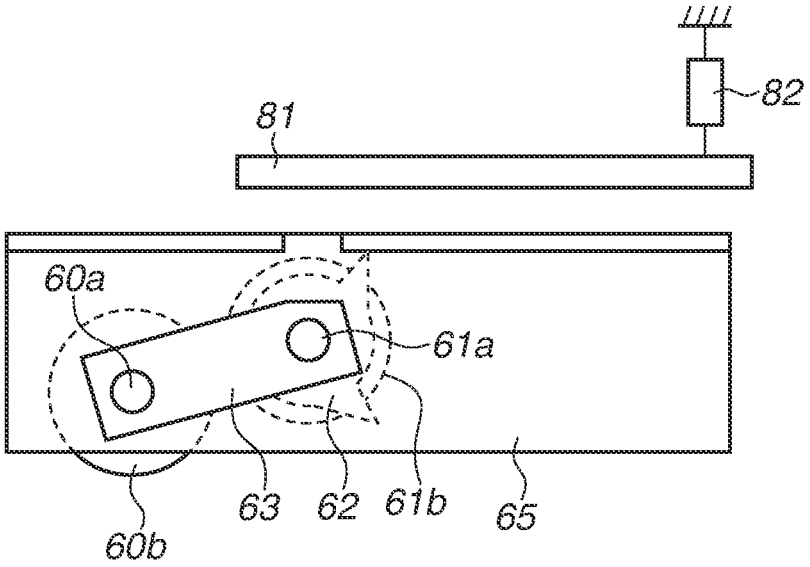

FIG. 6A illustrates a configuration as a first comparative example in which the metal spring 70 is directly brought into contact with the grounding member 81 without disposing the sheet member 67*a* and the spacer member 67*b*, and the shutter member 62 is electrically connected to the earth via the resistor 82 having the resistance value of 5 GΩ. At that point, the shutter member 62 is in a grounded state. FIG. 6B illustrates a configuration as a second comparative example in which the metal spring 70 is removed from the first comparative example, and the shutter member 62 is electrically insulated. At that point, the shutter member 62 is in a state which is not grounded (non-grounded state).

According to the first comparative example, the shutter member 62 is electrically connected to the earth via the resistor 82, so that an image defect due to a leakage of a transfer current via the transfer material P and over charging of the shutter member 62 can be suppressed.

However, depending on a type and a use environment of the transfer material P, the transfer material P may have a potential when being brought into contact with the secondary transfer roller 20 under the influence of the secondary transfer voltage. When the transfer material P abuts on the secondary transfer roller 20 to which the secondary transfer voltage is applied at the secondary transfer nip portion, the transfer material P is charged by a secondary transfer current. On the other hand, the identical transfer material P is in contact with any of the projecting portions of the shutter member 62 at the conveyance nip portion, and the transfer material P is slid with the projecting portion following the conveyance of the transfer material P. At that point, the shutter member 62 is grounded, so that the transfer material P is slid with the shutter member 62 in a state in which a potential difference is generated between the transfer material P and the shutter member 62. A potential of the transfer material P and a potential of the shutter member 62 at the conveyance nip portion are determined by partial pressures of a resistance of the transfer material P in an interval between the secondary transfer nip portion and the conveyance nip portion, a contact resistance of the transfer material P and the shutter member 62, a resistance of the resistor 82, and the like. Therefore, as long as there is the contact resistance of the transfer material P and the shutter member 62, a certain amount of the potential difference is generated between the transfer material P and the shutter member 62.

When the transfer material P is slid with any of the projecting portions of the shutter member 62 in a state with the potential difference, charging or destaticizing occurs at a position at which the transfer material P is slid with any of the projecting portions of the shutter member 62, and a charging state of the transfer material P is changed. The charging state of the transfer material P changed by the sliding with any of the projecting portions of the shutter member 62 is referred to as an electrostatic record.

Especially, in a configuration like the shutter member 62 in which the transfer material P is in contact with the shutter member 62 only at a position at which the transfer material P is in contact with the projection, in other words, a configuration in which the shutter member 62 is slid with not an entire surface but a part of the transfer material P, the generated electrostatic record becomes a factor of the image defect. For example, when the transfer material P is slid with the shutter member 62 in the state with the potential difference and then a toner image is transferred at the secondary transfer nip portion, a transferability of a portion having the electrostatic record on the transfer material P is different from that of the other portion, and there is a risk that a longitudinal striped image defect may be generated.

According to the second comparative example, the shutter member 62 is in an electrically insulated state. When the transfer material P slid with the shutter member 62 reaches the secondary transfer nip portion in this state and has a potential under the influence of the secondary transfer current, the shutter member 62 being in contact with the transfer material P will have a potential same as that of the transfer material P. Therefore, a potential difference is not generated between the transfer material P and the shutter member 62, and the electrostatic record is not generated on the transfer material P, so that generation of a longitudinal striped image defect can be suppressed.

However, the configuration does not include a path to release the charge accumulated in the shutter member 62, so that the shutter member 62 is easy to be charged. Especially, when the transfer materials P are successively conveyed under a low humidity environment and the like, the shutter member 62 is excessively charged by the sliding with the transfer material P. According to the second comparative example, when the shutter member 62 was charged to a potential of 3000 V or higher, electrical noise generation due to discharging was confirmed. Such electrical noise has a risk to be a cause of malfunction of the image forming apparatus.

Figure 7A:
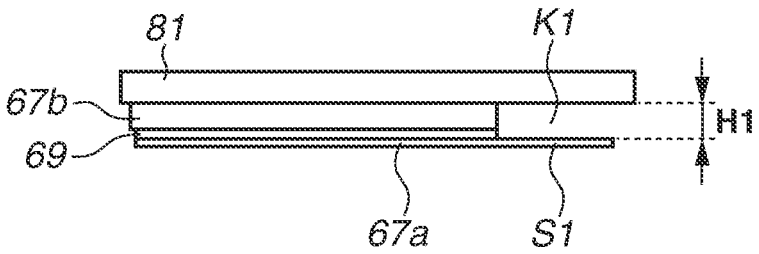
FIGS. 7A to 7C are schematic diagrams illustrating operations of the connection member according to the first exemplary embodiment.
Figure 7B:
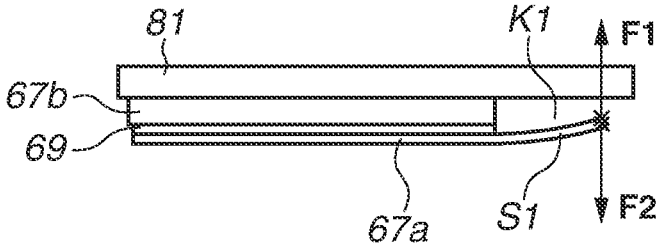
Figure 7C:
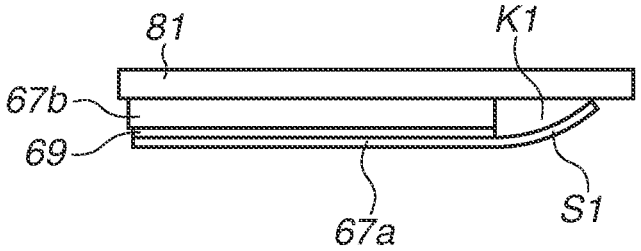

Next, operations of the deforming portion S1 of the sheet member 67*a* in the switch unit 67 according to the present exemplary embodiment are described with reference to FIGS. 7A to 7C. FIGS. 7A to 7C are schematic drawings illustrating how the deforming portion S1 of the sheet member 67*a* electrically connected to the shutter member 62 is deformed in response to the potential of the shutter member 62 and abuts on the grounding member 81. Regarding the switch unit 67 in FIGS. 7A to 7C, members excepting the sheet member 67*a*, the spacer member 67*b*, the double-sided adhesive tape 69, and the grounding member 81 are omitted from the illustration.

When the shutter member 62 does not have a potential, the sheet member 67*a* has a straight line shape as in FIG. 7A, and the deforming portion S1 of the sheet member 67*a* remains still in a predetermined position (hereinbelow, referred to as a separated position according to the present exemplary embodiment). At that point, the void K1 is formed between the grounding member 81 and the deforming portion S1 of the sheet member 67*a* by the spacer member 67*b*. When the shutter member 62 is charged and has a potential, a charge is accumulated on a surface of the sheet member 67*a* electrically connected to the shutter member 62. The accumulated charge generates an electrostatic force F1 between the grounding member 81 and the deforming portion S1 of the sheet member 67*a*, and the deforming portion S1 of the sheet member 67*a* remaining still at the separated position is drawn toward the grounding member 81. In other words, the deforming portion S1 of the sheet member 67*a* is deformed by the electrostatic force F1 acting between the grounding member 81 and the sheet member 67*a*.

As illustrated in FIG. 7B, when the potential of the shutter member 62 is low, the electrostatic force F1 of the sheet member 67*a* is small, and the sheet member 67*a* is stopped at a position at which a restorative force F2 generated by the deformation of the deforming portion S1 of the sheet member 67*a* and the electrostatic force F1 are balanced with each other. In other words, the shutter member 62 is electrically insulated.

As illustrated in FIG. 7C, when the potential of the shutter member 62 is high, the deforming portion S1 of the sheet member 67*a* electrically connected to the shutter member 62 is strongly drawn toward the grounding member 81 side by the electrostatic force F1. In other words, when the electrostatic force F1 becomes larger than the restorative force F2, the deforming portion S1 of the sheet member 67*a* is deformed and abuts on the grounding member 81 via the void K1. Accordingly, the shutter member 62 is conducted to the grounding member 81 via the sheet member 67*a*. At that point, a resistance value of the sheet member 67*a* is 10 kΩ or lower, and the resistance value of the resistor is 5 GΩ, so that the shutter member 62 is in a state grounded via the resistance value of approximately 5 GΩ. According to the present exemplary embodiment, as an operation potential of the switch unit 67, when the potential of the shutter member 62 becomes 1200 V or higher, the deforming portion S1 of the sheet member 67*a* abuts on the grounding member 81. The operation potential of the switch unit 67 can be adjusted by the thickness of the spacer member 67*b*, the length of the deforming portion S1 of the sheet member 67*a*, the tensile modulus of the sheet member 67*a*, the thickness of the sheet member 67*a*, and the like, and can be appropriately adjusted according to a condition of an individual apparatus.

According to the present exemplary embodiment, when the potential of the shutter member 62 is less than 1200 V, the deforming portion S1 of the sheet member 67*a* is not deformed to the distance H1 by the electrostatic force F1, so that the deforming portion S1 of the sheet member 67*a* does not abut on the grounding member 81. In the configuration, the shutter member 62 is in the electrically insulated state, thus when the transfer material P reaches the secondary transfer nip portion and has a certain potential under the influence of the secondary transfer current, the shutter member 62 being in contact with the transfer material P will have a potential same as that of the transfer material P. Therefore, the electrostatic record is not generated on the transfer material P due to a potential difference between these members, and a longitudinal striped image defect can be suppressed.

According to the first comparative example, the electrostatic record on the transfer material P due to the sliding with the shutter member 62 was generated when the potential of the shutter member 62 was about 700 V. This potential value is lower than 1200 V which is the operation potential of the switch unit 67 according to the present exemplary embodiment. Therefore, in the configuration according to the present exemplary embodiment, the shutter member 62 can be maintained in the electrically insulated state when the potential of the shutter member 62 reaches 700 V, so that generation of the electrostatic record on the transfer material P due to sliding with the shutter member 62 can be suppressed.

When the shutter member 62 is maintained at the high potential after the deforming portion S1 of the sheet member 67*a* abutting on the grounding member 8, the deforming portion S1 of the sheet member 67*a* is kept abutting on the grounding member 81 by the electrostatic force F1. On the other hand, when the deforming portion S1 of the sheet member 67*a* abuts on the grounding member 81, the charge accumulated on the surface of the sheet member 67*a* is destaticized, and the potential of the shutter member 62 is lowered, so that the electrostatic force F1 becomes smaller than the restorative force F2. Accordingly, the deforming portion S1 of the sheet member 67*a* is released from the deformed state, and the sheet member 67*a* is separated from the grounding member 81. The shutter member 62 is electrically connected to the sheet member 67*a*, so that when the deforming portion S1 of the sheet member 67*a* is separated from the grounding member 81, the shutter member 62 is electrically insulated from the grounding member 81.

According to the present exemplary embodiment, when the potential of the shutter member 62 becomes 1200 V or higher, the deforming portion S1 of the sheet member 67*a* abuts on the grounding member 81, and the shutter member 62 is electrically connected to the earth via the grounding member 81 connected to the resistor 82. In this regard, it is desirable that a ground resistance of the shutter member has a resistance value from 50 MΩ to 50 GΩ, more desirably in a range from 100 MΩ to 20 GΩ. When the ground resistance of the shutter member 62 is too low, the secondary transfer current is leaked via the transfer material P, and a transfer defect cannot be suppressed. Whereas, when the ground resistance of the shutter member 62 is too high, excessive charging of the shutter member 62 due to the sliding with the transfer material P cannot be suppressed.

In a state in which the deforming portion S1 of the sheet member 67*a* abuts on the grounding member 81, the resistor 82 has the high resistance value, i.e., 5 GΩ, and thus a leakage of a transfer current to the member being in contact with the transfer material P can be suppressed. Further, when the shutter member 62 is charged to a predetermined potential or higher, the deforming portion S1 of the sheet member 67*a* is deformed by the electrostatic force F1 and abuts on the grounding member 81, and the shutter member 62 is electrically connected to the earth via the sheet member 67*a*. Accordingly, excessive charging of the shutter member 62 can be suppressed. According to the second comparative example, when the potential of the shutter member 62 was 3000 V or higher, the shutter member was excessively charged, and discharging occurred. Therefore, the configuration of the switch unit 67 having the operation potential of 1200 V according to the present exemplary embodiment can suppress discharging which is generated due to the excessive charging of the shutter member 62.

As described above, the configuration according to the present exemplary embodiment can switch grounding and non-grounding of the shutter member 62 as the slide member with a simple configuration. Accordingly, discharging generated by the excessive charging of the shutter member 62, the leakage of the transfer current via the transfer material P, the image defect which can be generated by the slide of the transfer material P with the shutter member 62 can be suppressed.

The switch unit 67 according to the present exemplary embodiment has a configuration in which the deforming portion S1 of the sheet member 67*a* is deformed by the electrostatic force F1 and abuts on the grounding member 81, and thus the shutter member 62 is electrically connected to the earth. In other words, in the grounding configuration according to the present exemplary embodiment, the deforming portion S1 of the sheet member 67*a* is deformed in response to a charged amount of the sheet member 67*a*, so that a detection unit for detecting a charged amount, a potential value, and the like is not necessary. Therefore, the switch unit 67 according to the present exemplary embodiment has a simple configuration since which is not the detection unit for detecting a charged amount and a potential nor a mechanical switch for moving the sheet member based on a result of the detection unit.

According to the present exemplary embodiment, the shutter member 62 is mainly described as the slide member, however, the conveyance guide 22 used in the present exemplary embodiment is also the conductive slide member with which the transfer material P is slid in the secondary transfer. Therefore, when the conveyance guide 22 is provided with the grounding configuration using the switch unit 67, an effect can be obtained which is similar to that according to the present exemplary embodiment. In addition, another conductive slide member with which the transfer material P is slid on the upstream side than the secondary transfer nip portion in the conveyance direction of the transfer material P can obtain a similar effect by adopting the present exemplary embodiment of the disclosure.

According to the present exemplary embodiment, the conductive resin including polyimide as a base material is used as the sheet member 67*a*, however, the base material of the conductive resin is not limited to polyimide, and a resin which can obtain conductivity by adding a conductive agent can be used. Further, according to the present exemplary embodiment, the conductive resin to which carbon is added as a conductive agent is used to the sheet member 67*a*, however, the conductive agent added to the conductive resin is not limited to carbon and may be a metallic conductive filler and an ionic conductive agent. Furthermore, according to the present exemplary embodiment, the thin plate-shaped conductive resin sheet is used as the sheet member 67*a*, however, a member which is conductive and deformable by a electrostatic force can be used without limiting to the above-described sheet member.

Figure 8A:
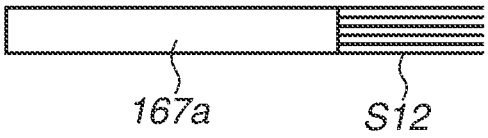
FIGS. 8A to 8D are schematic diagrams illustrating operations of a connection member according to an exemplary embodiment.
Figure 8B:
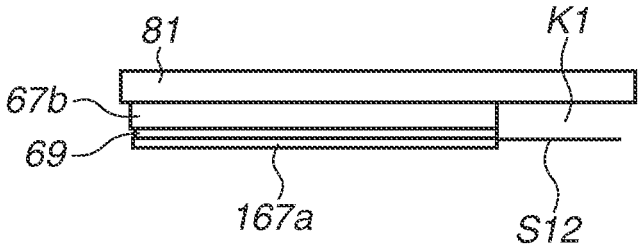
Figure 8C:
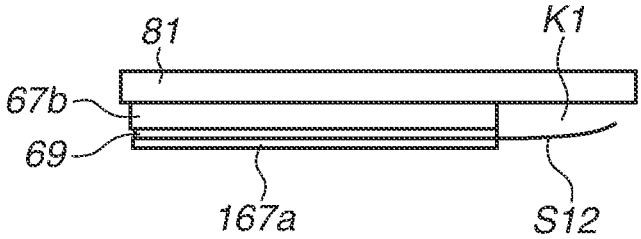
Figure 8D:
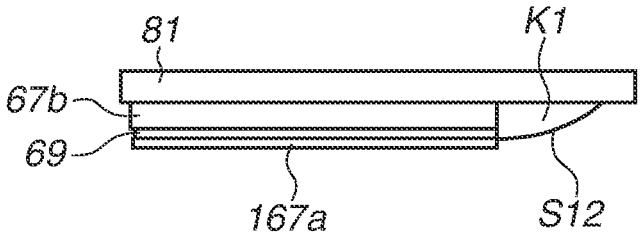

For example, FIGS. 8A to 8D illustrate an example using a sheet member 167*a* which includes a brush-shaped deforming portion S12 formed by bundling a plurality of stainless steel (SUS) threads as a connection member electrically connected to the shutter member 62 as a modification of the present exemplary embodiment. In FIGS. 8A to 8D, members excepting the sheet member 167*a*, the spacer member 67*b*, the double-sided adhesive tape 69, and the grounding member 81 are omitted from the illustration, and the configurations excepting the sheet member 167*a* are similar to those according to the first exemplary embodiment. FIG. 8A is a schematic diagram illustrating an external appearance of the sheet member 167*a*. FIGS. 8B, 8C, and 8D are schematic diagrams of states of the deforming portion S12 of the sheet member 167*a* respectively illustrating when the shutter member 62 does not have a potential, when the potential of the shutter member 62 is low, and when the potential of the shutter member 62 is high.

In the case that the sheet member 167*a* is used, the deforming portion S12 of the sheet member 167*a* remains still at the separated position without abutting on the grounding member 81 as illustrated in FIG. 8B when the shutter member 62 does not have a potential as with the case that the sheet member 67*a* is used. In other words, the shutter member 62 is in a state electrically insulated from the grounding member 81. At that point, the void K1 is formed between the grounding member 81 and the deforming portion S12 of the sheet member 167*a* by the spacer member 67*b*. When the potential of the sheet member 167*a* is low, the deforming portion S12 of the sheet member 167*a* is drawn from the separated position to the grounding member 81 by the electrostatic force as illustrated in FIG. 8C. When the potential of the sheet member 167*a* is high, the deforming portion S12 of the sheet member 167*a* is deformed in the void K1 and abuts on the grounding member 81 as illustrated in FIG. 8D. Accordingly, the shutter member 62 electrically connected to the sheet member 167*a* is grounded via the resistor 82 (not illustrated) having the resistance value of 5 GΩ connected to the grounding member 81, and thus an effect can be obtained which is similar to the case when the sheet member 67*a* according to the present exemplary embodiment is used.

According to the first exemplary embodiment, the configuration of the switch unit 67 is described in which the one end side of the sheet member 67*a* is regulated by the spacer member 67*b* and the other end side is a free end in the longitudinal direction of the sheet member 67*a*. In contrast, as illustrated in FIGS. 9A to 9C and FIGS. 10A to 10C, a configuration according to a second exemplary embodiment is to regulate the one end side and the other end side of the sheet member 67*a* and different in a point that a spacer member 267*b* is used of which a shape is different from the spacer member 67*b* according to the first exemplary embodiment. The configuration of the image forming apparatus according to the present exemplary embodiment is similar to that according to the first exemplary embodiment excepting a configuration of a switch unit 267, so that the configuration described with reference to FIGS. 9A to 9C and FIGS. 10A to 10C by assigning the same reference numerals to the similar portions.

According to the present exemplary embodiment, the shape of the spacer member 267*b* is changed, and thus the configuration has a higher robustness to variation in assembly of the sheet member 67*a* and the spacer member 267*b* in comparison with the switch unit 67 according to the first exemplary embodiment. The configuration of the switch unit 267 according to the present exemplary embodiment is similar to that according to the first exemplary embodiment excepting the shape of the spacer member 267*b*, so that the members common to those in the first exemplary embodiment are denoted by the same reference numerals in the first exemplary embodiment, and the descriptions thereof are omitted.

Figure 9A:
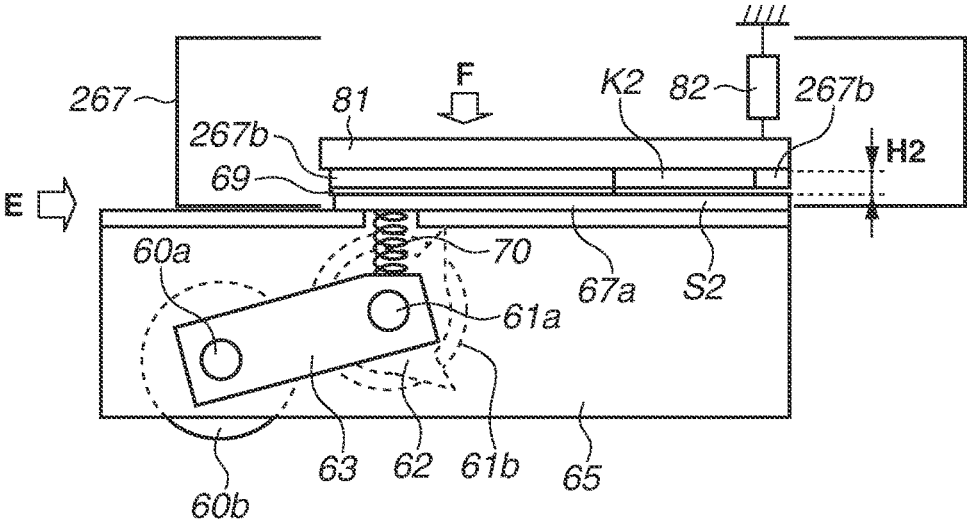
FIGS. 9A to 9C are schematic diagrams illustrating a grounding configuration of a slide member according to a second exemplary embodiment.
Figure 9B:
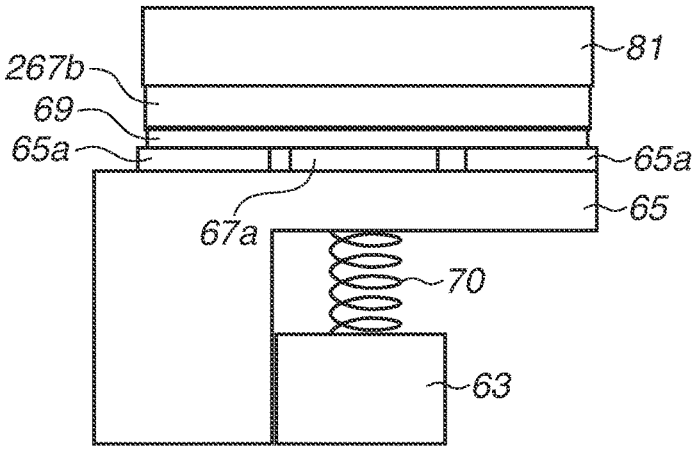

FIG. 9A illustrates the switch unit 267 viewed from the axial direction of the conveyance roller 60 (the illustrated arrow B direction in FIG. 2), and FIG. 9B is an enlarged cross-sectional view of the switch unit 267 viewed from the orthogonal direction (an illustrated arrow E direction in FIG. 9A) to the conveyance direction of the transfer material P. The switch unit 267 according to the present exemplary embodiment includes the sheet member 67*a* (a connection member), the spacer member 267*b*, the conductive double-sided adhesive tape 69, the grounding member 81, and the resistor 82. The sheet member 67*a* of the switch unit 267 is electrically connected to the conductive bearing 63 via the metal spring 70 and thus also electrically connected to a member which is conducted to the conductive bearing 63. The conductive bearing 63 holds the one end side of the core metal 60*a* of the conveyance roller 60 and the core metal 61*a* of the conveyance idler roller 61, so that the conductive bearing 63 is conducted to the conductive rubber roller 60*b* held by the core metal 60*a* and the conductive idler roller 61*b* and the shutter member 62 held by the core metal 61*a*. Therefore, according to the present exemplary embodiment, the shutter member 62 as the slide member slid with the transfer material P is electrically connected to the sheet member 67*a* as the connection member.

The spacer member 267*b* according to the present exemplary embodiment is an insulating polycarbonate sheet and has a width direction length of 15 mm and a thickness of 0.25 mm. The sheet member 67*a* and the spacer member 267*b* are sandwiched between the insulating frame 65 and the grounding member 81. The spacer member 267*b* is disposed by being sandwiched between the sheet member 67*a* and the grounding member 81 so as to keep a distance between the sheet member 67*a* and the grounding member 81 constant. As illustrated in FIG. 9A, the spacer member 267*b* according to the present exemplary embodiment includes an opening portion for forming a void K2 between the sheet member 67*a* and the grounding member 81. The sheet member 67*a* corresponding to a position corresponding to the opening portion of the spacer member 267*b* is a deforming portion S2 of the sheet member 67*a* according to the present exemplary embodiment, and the deforming portion S2 is disposed on the void K2.

As illustrated in FIG. 9B, the sheet member 67*a* is fixed to the projection 65*a* of the insulating frame 65 at the one end side and the other end side of the sheet member 67*a* by the spacer member 267*b* with the double-sided adhesive tape 69 having a thickness of 0.1 mm in the longitudinal direction of the sheet member 67*a*. The height of the projection 65*a* is 0.08 mm which is the same as the thickness of the sheet member 67*a*. The spacer member 267*b* has a thickness of 0.25 mm, and the double-sided adhesive tape 69 has a thickness of 0.1 mm, so that a distance H2 between the grounding member 81 and the deforming portion S2 of the sheet member 67*a* is 0.35 mm.

According to the present exemplary embodiment, the double-sided adhesive tape 69 is not stuck on the opening portion of the spacer member 267*b* and a portion 5 mm from the leading edge of the sheet member 67*a* in the longitudinal direction so as not to interfere the operation of the sheet member 67*a*. In other words, the sheet member 67*a* is regulated by the spacer member 267*b* at the one end side and the other end side in the longitudinal direction of the sheet member 67*a* and includes the deforming portion S2 between the one end side and the other end side of the sheet member 67*a*. The spacer member 267*b* includes the opening portion in which the void K2 can be formed between the one end side and the other end side of the sheet member 67*a*.

Figure 9C:
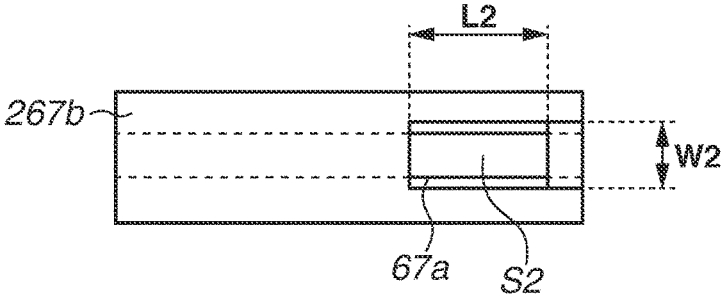

FIG. 9C is a schematic diagram illustrating the spacer member 267*b* and the sheet member 67*a* viewed from an illustrated arrow F direction in FIG. 9A, and the opening portion of the spacer member 267*b* has a width W2 of 7 mm and a length L2 of 16.0 mm. The width W2 of the opening portion of the spacer member 267*b* which forms the void K2 between the grounding member 81 and the deforming portion S2 of the sheet member 67*a* needs to be larger than the width of the sheet member 67*a*. This is because that the spacer member 267*b* is prevented from interfering the deformation of the deforming portion S2 of the sheet member 67*a* when the switch unit 267 is operated. When the length L2 of the opening portion is long, the operation potential of the switch unit 267 becomes lower, whereas when the length L2 is short, the operation potential of the switch unit 267 becomes higher. Therefore, the thickness and the length L2 of the opening portion of the spacer member 267*b* can be appropriately adjusted so that a desired operation potential can be obtained under conditions of the sheet member 67*a* such as a tensile modulus and a thickness.

The grounding member 81 is a metal plate and electrically connected to the earth via the resistor 82 as similar to the first exemplary embodiment. According to the present exemplary embodiment, a resistor having a resistance value of 5 GΩ is used as the resistor 82 by the similar reason to that according to the first exemplary embodiment.

Figure 10A:
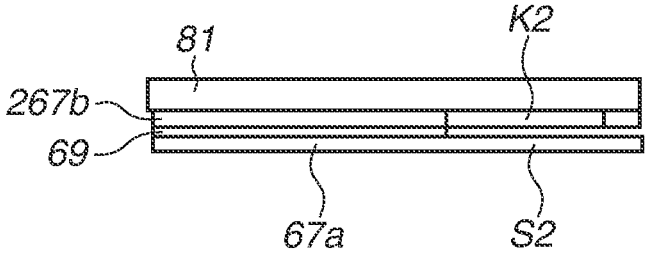
FIGS. 10A to 10C are schematic diagrams illustrating operations of a connection member according to the second exemplary embodiment.
Figure 10B:
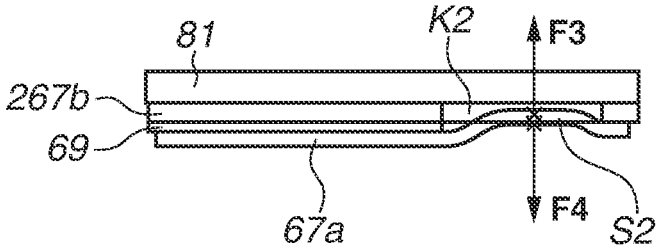
Figure 10C:
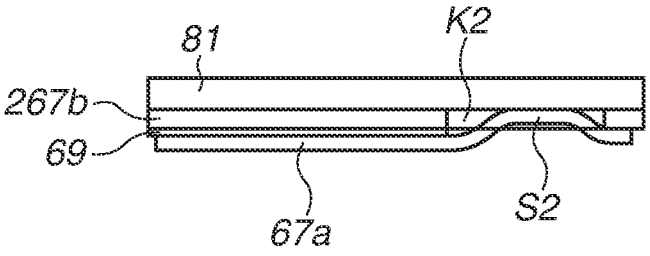

According to the present exemplary embodiment, the operation potential of the switch unit 267 is 1200 V as with the first exemplary embodiment. FIGS. 10A, 10B, and 10C are schematic diagrams of states of the sheet member 67*a* according to the present exemplary embodiment respectively illustrating when the shutter member 62 does not have a potential, when the potential of the shutter member 62 is low, and when the potential of the shutter member 62 is high.

When the shutter member 62 does not have a potential, the sheet member 67*a* has a straight line shape as in FIG. 10A, and the deforming portion S2 of the sheet member 67*a* remains still in a predetermined position (hereinbelow, referred to as a separated position according to the present exemplary embodiment). At that point, the void K2 is formed between the grounding member 81 and the deforming portion S2 of the sheet member 67*a* by the spacer member 267*b*. When the shutter member 62 is charged by the sliding with the transfer material P and has a potential, a charge is accumulated on the surface of the sheet member 67*a* electrically connected to the shutter member 62. The accumulated charge generates an electrostatic force F3 between the grounding member 81 and the deforming portion S2 of the sheet member 67*a*, and the deforming portion S2 of the sheet member 67*a* remaining still at the separated position is drawn toward the grounding member 81. In other words, the deforming portion S2 of the sheet member 67*a* is deformed by the electrostatic force F3 acting between the grounding member 81 and the sheet member 67*a*.

As illustrated in FIG. 10B, when the potential of the shutter member 62 is lower than 1200 V, the electrostatic force F3 of the sheet member 67*a* is smaller than a restorative force F4, and the shutter member 62 is not grounded. When the potential of the sheet member 67*a* is high, the electrostatic force F3 becomes larger than the restorative force F4, and the deforming portion S2 of the sheet member 67*a* is deformed so as to be drawn from the separated position to the grounding member 81 by the electrostatic force F3 at the void K2. As a result, the deforming portion S2 of the sheet member 67*a* is deformed by the electrostatic force F3 as illustrated in FIG. 10C, and the sheet member 67*a* abuts on the grounding member 81 via the void K1 with a shape in which a center thereof is lifted up. Accordingly, the shutter member 62 electrically connected to the sheet member 67*a* is conducted to the grounding member 81 via the sheet member 67*a*.

As with the first exemplary embodiment, when the deforming portion S2 of the sheet member 67*a* abuts on the grounding member 81, the charge accumulated on the surface of the sheet member 67*a* is destaticized, and the potential of the shutter member 62 is lowered, so that the electrostatic force F3 becomes smaller than the restorative force F4. Accordingly, the deforming portion S2 of the sheet member 67*a* is released from the deformed state, and the sheet member 67*a* is separated from the grounding member 81. The shutter member 62 is electrically connected to the sheet member 67*a*, so that when the deforming portion S2 of the sheet member 67*a* is separated from the grounding member 81, the shutter member 62 is electrically insulated from the grounding member 81.

As with the first exemplary embodiment, the switch unit 267 according to the present exemplary embodiment has the configuration in which the deforming portion S2 of the sheet member 67*a* is deformed by the electrostatic force F3 and abuts on the grounding member 81, and thus the shutter member 62 is electrically connected to the earth. In other words, in the grounding configuration according to the present exemplary embodiment, the deforming portion S2 of the sheet member 67*a* is also deformed in response to the charged amount of the sheet member 67*a*, so that the detection unit for detecting a charged amount, a potential value, and the like is not necessary. Accordingly, the switch unit 267 can have a simple configuration. Therefore, the switch unit 267 according to the present exemplary embodiment has a simple configuration since which is not the detection unit for detecting a charged amount and a potential nor a mechanical switch for moving the sheet member based on a result of the detection unit.

The present exemplary embodiment can obtain an effect similar to that of the first exemplary embodiment by the above-described operations.

According to the first exemplary embodiment, a protrusion amount of the sheet member 67*a* from the spacer member 67*b* is 8 mm. The protrusion amount of the sheet member 67*a* is changed by variation of an attached position of the sheet member 67*a* to the spacer member 67*b* and affects the operation potential of the switch unit 67. In other words, when the protrusion amount is large, the operation potential of the switch unit 67 becomes lower, whereas when the protrusion amount is small, the operation potential of the switch unit 67 becomes higher. In addition, the operation potential of the switch unit 67 is largely affected by a curled state of the leading edge portion of the sheet member 67*a*.

On the other hand, according to the present exemplary embodiment, the length L2 of the opening portion is determined by stamping of the spacer member 267*b*, so that the operation potential of the switch unit 267 is less affected by the variation of the attached position of the sheet member 67*a*. In addition, compared to the configuration according to the first exemplary embodiment, the leading edge portion of the sheet member 67*a* according to the present exemplary embodiment is regulated in a thickness direction by the spacer member 267*b*, so that the curled state of the leading edge portion of the sheet member 67*a* has a small effect on the switch unit 267.

Therefore, the configuration according to the present exemplary embodiment can provide the switch unit 267 having a higher robustness to variation in assembly of the sheet member 67*a* and the spacer member 67*b* and the operation state of the deforming portion S2 of the sheet member 67*a* in addition to the effect of the first exemplary embodiment.

Figure 11A:
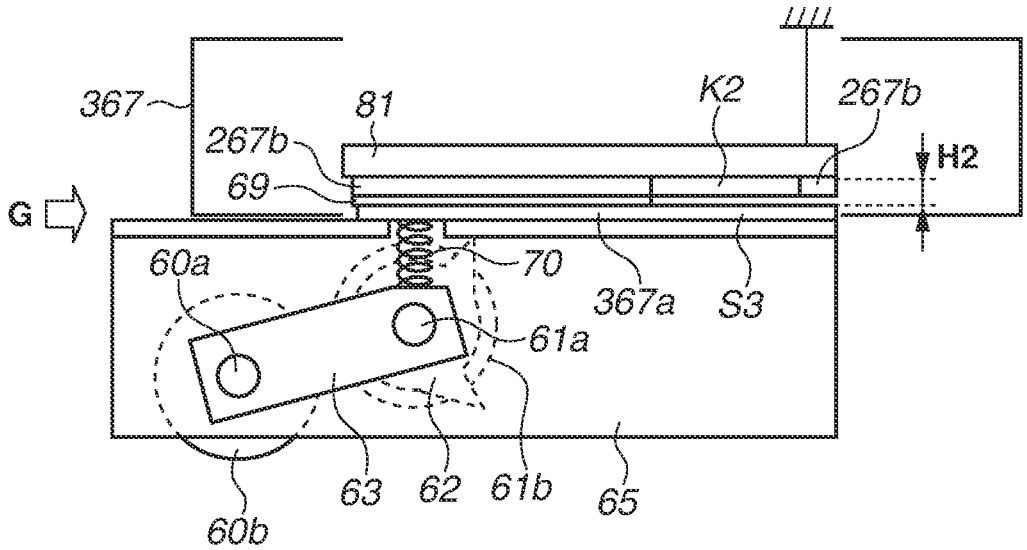
FIGS. 11A and 11B are schematic diagrams illustrating a grounding configuration of a slide member according to a third exemplary embodiment.
Figure 11B:
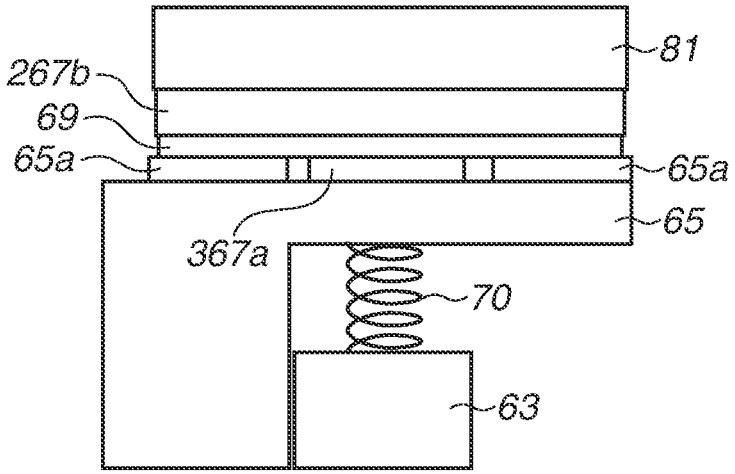

According to the second exemplary embodiment, the grounding configuration of the shutter member 62 is described in which the deforming portion S2 of the sheet member 67*a* electrically connected to the shutter member 62 is deformed by the electrostatic force F3 in the void K2 formed by the spacer member 267*b* and abuts on the grounding member 81. Further, according to the second exemplary embodiment, the grounding member 81 is electrically connected to the earth via the resistor 82. In contrast, according to a third exemplary embodiment, a grounding configuration of the shutter member 62 is described which includes a sheet member 367*a* having a resistance value different from that of the sheet member 67*a* according to the second exemplary embodiment and uses the grounding member 81 electrically connected to the earth without the resistor 82 as illustrated in FIGS. 11A and 11B. The configuration of the image forming apparatus according to the present exemplary embodiment is similar to that according to the second exemplary embodiment excepting the grounding configuration of the shutter member 62, so that the configuration described by assigning the same reference numerals to the similar portions.

According to the present exemplary embodiment, the sheet member 367*a* can also serve as the resistor by appropriately adjusting the resistance value thereof, and thus space saving and cost reduction can be achieved. The configuration of a switch unit 367 according to the present exemplary embodiment is similar to that according to the second exemplary embodiment excepting that the resistor 82 is not used and the resistance value of the sheet member 367*a*, so that the members common to those in the second exemplary embodiment are denoted by the same reference numerals in the second exemplary embodiment, and the descriptions thereof are omitted. Further, a deforming portion S3 of the sheet member 367*a* and the void K2 formed by the spacer member 267*b* according to the present exemplary embodiment are similar to those according to the second exemplary embodiment, and the descriptions thereof are omitted.

FIGS. 11A and 11B illustrate the grounding configuration of the shutter member 62 according to the present exemplary embodiment in which the shutter member 62 is electrically connected to the sheet member 367*a*, and the spacer member 267*b* similar to that according to the second exemplary embodiment is used. FIG. 11A illustrates the switch unit 367 viewed from the axial direction of the conveyance roller 60 (the illustrated arrow B direction in FIG. 2). FIG. 11B is an enlarged cross-sectional view of the switch unit 367 viewed from the orthogonal direction (an illustrated arrow G direction in FIG. 11A) to the conveyance direction of the transfer material P.

According to the present exemplary embodiment, the sheet member 367*a* is used which has a resistance value of approximately 5 GΩ between the one end side and the other end side in the longitudinal direction of the sheet member 367*a*. The resistance value of the sheet member 367*a* is obtained by adjusting an addition amount and a dispersion state of a conductive agent (carbon). The sheet member 367*a* is disposed using an attaching method similar to that of the sheet member 267*a* according to the second exemplary embodiment.

According to the present exemplary embodiment, an operation potential of the switch unit 367 is 1200 V which is similar to that of the second exemplary embodiment, and an effect similar to that of the second exemplary embodiment can be obtained. Further, according to the present exemplary embodiment, the sheet member 367*a* has a high resistance value, i.e., 5 GΩ, and thus a leakage of a transfer current can be suppressed without the resistor 82. Accordingly, using the configuration according to the present exemplary embodiment enables space saving and cost reduction in addition to the effect of the second exemplary embodiment.

Figure 12:
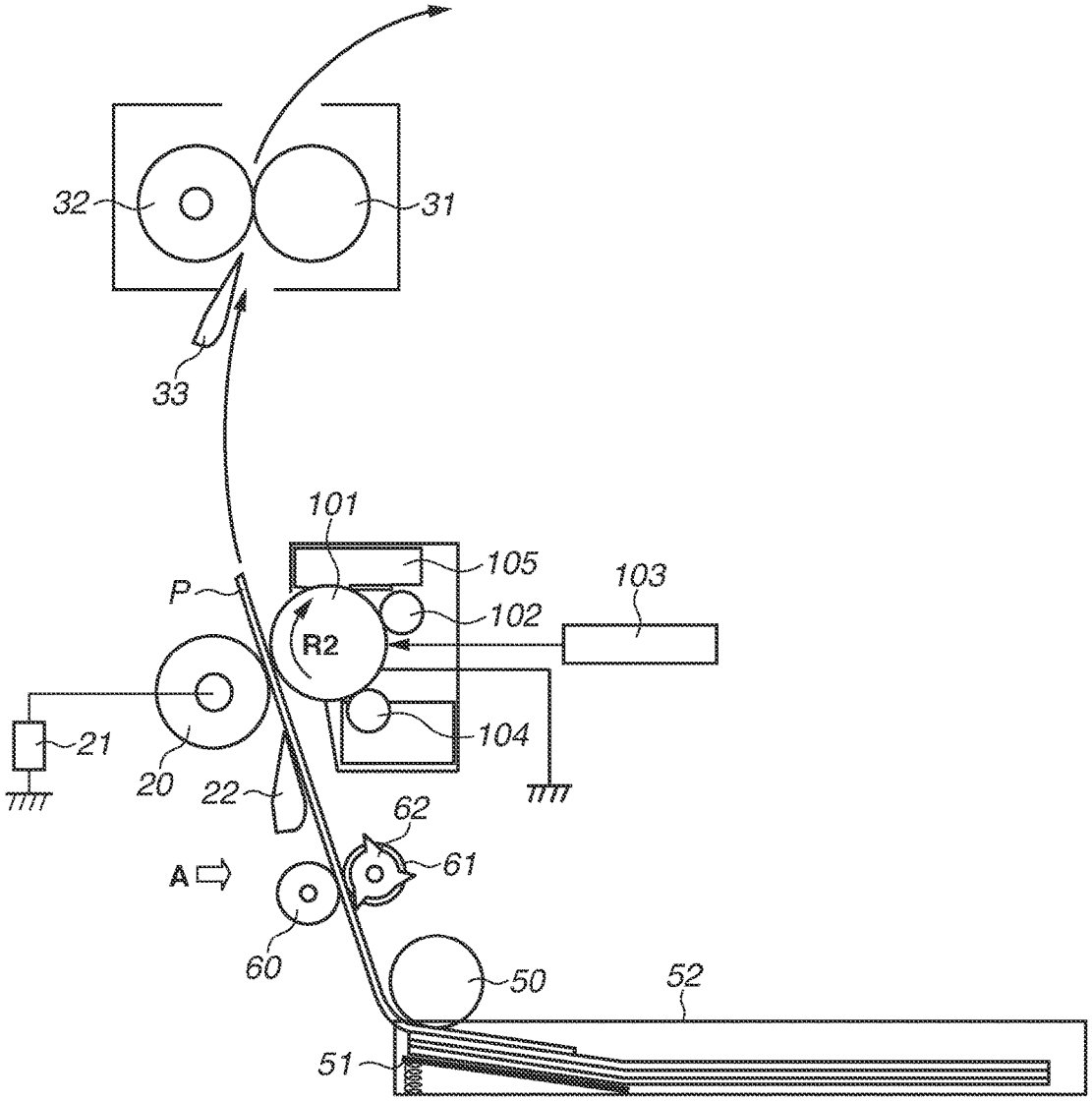
FIG. 12 is a schematic cross sectional view illustrating an image forming apparatus according to another exemplary embodiment.

The exemplary embodiments adaptable to the color image forming apparatus are described above, however, the present disclosure is not limited to the above-described exemplary embodiments. The embodiments of the present disclosure can be applied as long as an apparatus includes a transfer unit in which a toner image is transferred to a transfer material P and a slide member slid with the transfer material P on an upstream side than a transfer area in the conveyance direction of the transfer material P. In other words, as illustrated in FIG. 12, the present disclosure can be applied to a monochromatic image forming apparatus as another exemplary embodiment, and the similar effect can be obtained.

An image forming unit of the image forming apparatus according to the present exemplary embodiment includes a photosensitive drum 101 as an image bearing member, a charging roller 102, a development unit 104, and a drum cleaning member 105.

When a control unit (not illustrated) receives an image signal, an image forming operation is started, and the photosensitive drum 101 is rotated and driven to an illustrated arrow R2 direction (a counterclockwise direction). The photosensitive drum 101 is uniformly charged to a predetermined potential in a predetermined polarity by the charging roller 102 and exposed with light corresponding to the image signal by an exposure unit 103 in a rotation process. By the operations, an electrostatic latent image corresponding to a target image is formed on the photosensitive drum 101, and then, the electrostatic latent image is developed at a development position by the development unit 104 and visualized as a toner image on the photosensitive drum 101.

The photosensitive drum 101 faces a transfer roller 120 as a transfer member and forms a transfer nip portion (a transfer area). The transfer material P fed from the sheet feeding cassette 52 is conveyed to the transfer nip portion through a conveyance nip portion and then transferred the toner image thereto at the transfer nip portion. A transfer power source 121 as a voltage application unit applies a voltage to the transfer roller 120, so that the toner image is transferred from the photosensitive drum 101 to the transfer material P. Subsequently, the transfer material P is heated and pressurized in a fixing nip portion, and the toner image is fixed to the transfer material P.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-007466, filed Jan. 18, 2016, which is hereby incorporated by reference herein in its entirety.

What is claimed is:

1. An image forming apparatus comprising:

an image bearing member configured to bear a toner image;

a transfer member configured to form a transfer area with the image bearing member and transfer the toner image from the image bearing member to a transfer material at the transfer area;

a slide member configured to slide with the transfer material in a case that the transfer material is brought into contact with the transfer member;

a grounding member configured to be electrically connected to the earth; and a connection member having conductivity and configured to be electrically connected to the slide member, wherein the connection member comprises a deforming portion deformed by an electrostatic force acting between the grounding member and the connection member, the slide member is conducted to the grounding member via the connection member in a case that the deforming portion is deformed and abuts on the grounding member, and the slide member is electrically insulated from the grounding member in a case that the deforming portion is separated from the grounding member.

2. The image forming apparatus according to claim 1, wherein a charge is accumulated in the connection member by that the slide member is slid with the transfer material and charged, and an electrostatic force acts between the grounding member and the deforming portion.

3. The image forming apparatus according to claim 2, wherein when the deforming portion abuts on the grounding member, the charge accumulated to the connection member is destaticized, a deformed state of the deforming portion is resolved, and the deforming portion is separated from the grounding member.

4. The image forming apparatus according to claim 1 further comprising:

a spacer member disposed between the grounding member and the connection member and configured to form a void between the grounding member and the deforming portion.

5. The image forming apparatus according to claim 1, wherein the connection member is a conductive sheet-shaped member.

6. The image forming apparatus according to claim 5, wherein the connection member is regulated by the spacer member on one end side and comprises the deforming portion on another end side thereof.

7. The image forming apparatus according to claim 5, wherein the connection member is regulated by the spacer member on one end side and another end side thereof and comprises the deforming portion between the one end side and the another end side.

8. The image forming apparatus according to claim 1, wherein the grounding member is electrically connected to the earth via a resistor.

9. The image forming apparatus according to claim 1, wherein the slide member is disposed on a conveyance path via which the transfer material is conveyed to the transfer area on an upstream side than the transfer area in a conveyance direction of the transfer material and rotatable by conveyance of the transfer material.

10. The image forming apparatus according to claim 9, wherein the slide member comprises a plurality of projecting portions protruding to be in contact with the transfer material.

11. The image forming apparatus according to claim 10, wherein the slide member corrects skew of the transfer material by attaching the projecting portion to a leading edge of the transfer material.

12. The image forming apparatus according to claim 11, wherein a plurality of the slide members is disposed on a width direction intersecting the conveyance direction of the transfer material.

13. The image forming apparatus according to claim 1, further comprising:

a voltage application unit configured to apply a voltage to the transfer member; and a counter member configured to face the transfer member via the image bearing member, wherein the counter member has conductivity, and an electric current is supplied from the transfer member to the counter member by applying a voltage from the voltage application unit to the transfer member.

14. The image forming apparatus according to claim 1, further comprising a photosensitive member, wherein the image bearing member is an endless intermediate transfer belt bearing the toner image transferred from the photosensitive member.

15. The image forming apparatus according to claim 1, wherein the image bearing member is a photosensitive member on which an electrostatic latent image is developed by a development unit.

16. An image forming apparatus comprising:

an image bearing member configured to bear a toner image;

a transfer member configured to form a transfer area with the image bearing member and transfer the toner image from the image bearing member to a transfer material at the transfer area;

a slide member configured to slide with the transfer material in a case that the transfer material is brought into contact with the transfer member;

a grounding member having conductivity and configured to be electrically connected to the earth;

a sheet member having conductivity and configured to be electrically connected to the slide member; and a spacer member having an insulation property and configured to form a void between the grounding member and the sheet member;

wherein the sheet member abuts on and separates from the grounding member via the void.

17. The image forming apparatus according to claim 16, wherein a charge is accumulated in the sheet member by that the slide member is slid with the transfer material and charged, and the sheet member abuts on the grounding member via the void by the charge accumulated to the sheet member.

18. The image forming apparatus according to claim 17, wherein the sheet member abuts on the grounding member via the void, and the charge accumulated in the sheet member is destaticized, so that the sheet member is separated from the grounding member.

19. The image forming apparatus according to claim 16, wherein the sheet member is regulated by the spacer member on one end side and disposed in the void on another end side thereof.

20. The image forming apparatus according to claim 16, wherein the sheet member is regulated by the spacer member on one end side and another end side thereof, and the spacer member forms the void between the one end side and the another end side of the sheet member.

* * * * *